US008257071B2

(12) United States Patent
Matsuki et al.

(10) Patent No.: US 8,257,071 B2
(45) Date of Patent: Sep. 4, 2012

(54) VANE PUMP

(75) Inventors: Etsuo Matsuki, Kadoma (JP); Masaaki Nishikata, Kadoma (JP); Tsuyoshi Kusakabe, Hakata-ku (JP); Tsukasa Hojo, Kadoma (JP); Ken Yamamoto, Kadoma (JP)

(73) Assignee: Panasonic Corporation, Osaka (JP)

( * ) Notice: Subject to any disclaimer, the term of this patent is extended or adjusted under 35 U.S.C. 154(b) by 451 days.

(21) Appl. No.: 12/458,469

(22) Filed: Jul. 14, 2009

(65) Prior Publication Data

US 2010/0015001 A1 Jan. 21, 2010

(30) Foreign Application Priority Data

Jul. 18, 2008 (JP) ..... 2008-187209

(51) Int. Cl.
*F03C 2/00* (2006.01)
*F03C 4/00* (2006.01)
*F04C 18/00* (2006.01)

(52) U.S. Cl. ..... 418/259; 418/145; 418/268

(58) Field of Classification Search ..... 418/77, 418/104, 140, 142, 145, 147, 148, 259, 266–268
See application file for complete search history.

(56) References Cited

U.S. PATENT DOCUMENTS

| | | | | |
|---|---|---|---|---|
| 1,492,456 | A * | 4/1924 | Hansen-Ellehammer | 418/260 |
| 2,536,938 | A * | 1/1951 | Hunter | 418/265 |
| 4,561,834 | A | 12/1985 | Poss | |
| 4,898,526 | A | 2/1990 | Sakamaki et al. | |
| 2008/0219873 | A1 | 9/2008 | Nishikata et al. | |

FOREIGN PATENT DOCUMENTS

| | | | | |
|---|---|---|---|---|
| JP | S52-137705 | | 11/1977 | |
| JP | 55043211 | A * | 3/1980 | 418/268 |
| JP | 01267385 | A * | 10/1989 | 418/268 |
| JP | H06042477 | | 2/1994 | |
| JP | H09-042187 | | 2/1997 | |
| JP | 2008-128201 | | 6/2008 | |
| JP | 2008-151113 | | 7/2008 | |

OTHER PUBLICATIONS

Chinese office action dated Nov. 3, 2010 and English translation thereof.
Korean Office Action dated May 2, 2011 and English summary thereof.
Chinese Office Action dated May 10, 2011 and English translation thereof.
English summary of the Japanese Office Action dated May 18, 2010.

* cited by examiner

*Primary Examiner* — Theresa Trieu
(74) *Attorney, Agent, or Firm* — Bacon & Thomas, PLLC

(57) ABSTRACT

A vane pump includes a casing and a rotary unit rotatably held within the casing. The rotary unit includes a base portion with radially outwardly opened slits extending radially with respect to a rotational axis of the rotary unit and vanes slidably fitted in the respective slits. An annular chamber is formed around the base portion within the casing and divided into a plurality of pump chambers by the vanes. Each of the pump chambers has a volume cyclically expanded and contracted during rotation of the rotary unit to discharge the fluid drawn into each of the pump chambers. The casing includes an inlet port through which to draw the fluid into the annular chamber. The inlet port is arranged to face a portion of the annular chamber extending between a middle position and a terminating position of an expanding section in which each of the pump chambers expands.

4 Claims, 5 Drawing Sheets

VANE PUMP

FIELD OF THE INVENTION

The present invention relates to a vane pump.

BACKGROUND OF THE INVENTION

In a vane pump, pump chambers divided by vanes are expanded in a 180° section, one half of 360° rotation angle of a rotating portion, and are contracted in the remaining 180° section. A fluid is drawn from an inlet port in the pump chamber expanding section (hereinafter simply referred to as an "expanding section"). The fluid is discharged through an outlet port in the pump chamber contracting section (hereinafter simply referred to as a "contracting section"). In a conventional vane pump disclosed in Japanese Patent Laid-open Publication No. 9-42187 (JP9-42187A), an inlet port is provided in the substantially middle position of an expanding section. Furthermore, an outlet port is provided in the substantially middle position of a contracting section. A discharge path extends from the outlet port in the radially outward direction of a rotational axis.

If the inlet port is formed in the substantially middle position of the expanding section as set forth in JP9-42187A, it is sometimes the case that turbulence or vortex of a fluid is generated particularly in the chamber portion just ahead of the inlet port along the rotational direction, thus reducing the pump efficiency. In addition, if the discharge path is formed to extend radially outwards from the outlet port, it is sometimes difficult for the fluid to smoothly flow from each of the pump chambers toward the discharge path, consequently generating the turbulence or vortex of a fluid and reducing the pump efficiency.

SUMMARY OF THE INVENTION

In view of the above, the present invention provides a vane pump capable of suppressing the reduction in pump efficiency attributable to the turbulence or vortex of a fluid generated in the vicinity of an inlet port or an outlet port.

In accordance with a first aspect of the present invention, there is provided a vane pump including: a casing; and a rotary unit rotatably held within the casing, the rotary unit including a base portion with a plurality of radially outwardly opened slits extending radially with respect to a rotational axis of the rotary unit and vanes slidably fitted in the respective slits, an annular chamber being formed around the base portion within the casing and divided into a plurality of pump chambers by the vanes, each of the pump chambers having a volume cyclically expanded and contracted during rotation of the rotary unit to discharge the fluid drawn into each of the pump chambers, wherein the casing includes an inlet port through which to draw the fluid into the annular chamber, the inlet port being arranged so as to face a portion of the annular chamber extending between a middle position and a terminating position of an expanding section in which each of the pump chambers expands.

The fluid moving from the intake path toward the annular chamber flows from the side distant from a line segment interconnecting the starting position and the terminating position of the expanding section of the pump chamber toward the line segment. Near the inlet port, the fluid in the pump chamber also flows toward the line segment. Therefore, the fluid introduced from the intake path into the annular chamber is prevented from colliding with the fluid moving together with the movement of the pump chamber. This makes it possible to suppress the reduction in pump efficiency attributable to the turbulence or vortex of the fluid which would otherwise be generated near the inlet port.

Preferably, the casing includes an intake path arranged on an upstream side of the inlet port, the intake path including a wall surface positioned on a radially outer side with respect to the rotational axis and joined to the inlet port so as to extend along a tangential line of an outer circumferential surface of the annular chamber.

The wall surface of the intake path can be smoothly joined to the outer circumferential surface of the annular chamber. This makes it possible to suppress the reduction in pump efficiency attributable to the separation or turbulence of the fluid.

Preferably, the casing includes an outlet port through which to discharge the fluid from the annular chamber and a discharge path arranged on a downstream side of the out port, the discharge path including a wall surface positioned on a radially outer side with respect to the rotational axis and joined to the outlet port so as to extend along a tangential line of an outer circumferential surface of the annular chamber.

The wall surface of the discharge path can be smoothly joined to the outer circumferential surface of the annular chamber. This makes it possible to suppress the reduction in pump efficiency attributable to the separation or turbulence of the fluid.

In accordance with a second aspect of the present invention, there is provided a vane pump including: a casing; and a rotary unit rotatably held within the casing, the rotary unit including a base portion with a plurality of radially outwardly opened slits extending radially with respect to a rotational axis of the rotary unit and vanes slidably fitted in the respective slits, an annular chamber being formed around the base portion within the casing and divided into a plurality of pump chambers by the vanes, each of the pump chambers having a volume cyclically expanded and contracted during rotation of the rotary unit to discharge the fluid drawn into each of the pump chambers, wherein the casing includes an outlet port through which to discharge the fluid from the annular chamber and a discharge path arranged on a downstream side of the out port, the discharge path including a wall surface positioned on a radially outer side with respect to the rotational axis and joined to the outlet port so as to extend along a tangential line of an outer circumferential surface of the annular chamber.

The wall surface of the discharge path can be smoothly joined to the outer circumferential surface of the annular chamber. This makes it possible to suppress the reduction in pump efficiency attributable to the separation or turbulence of the fluid.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Figure 1:
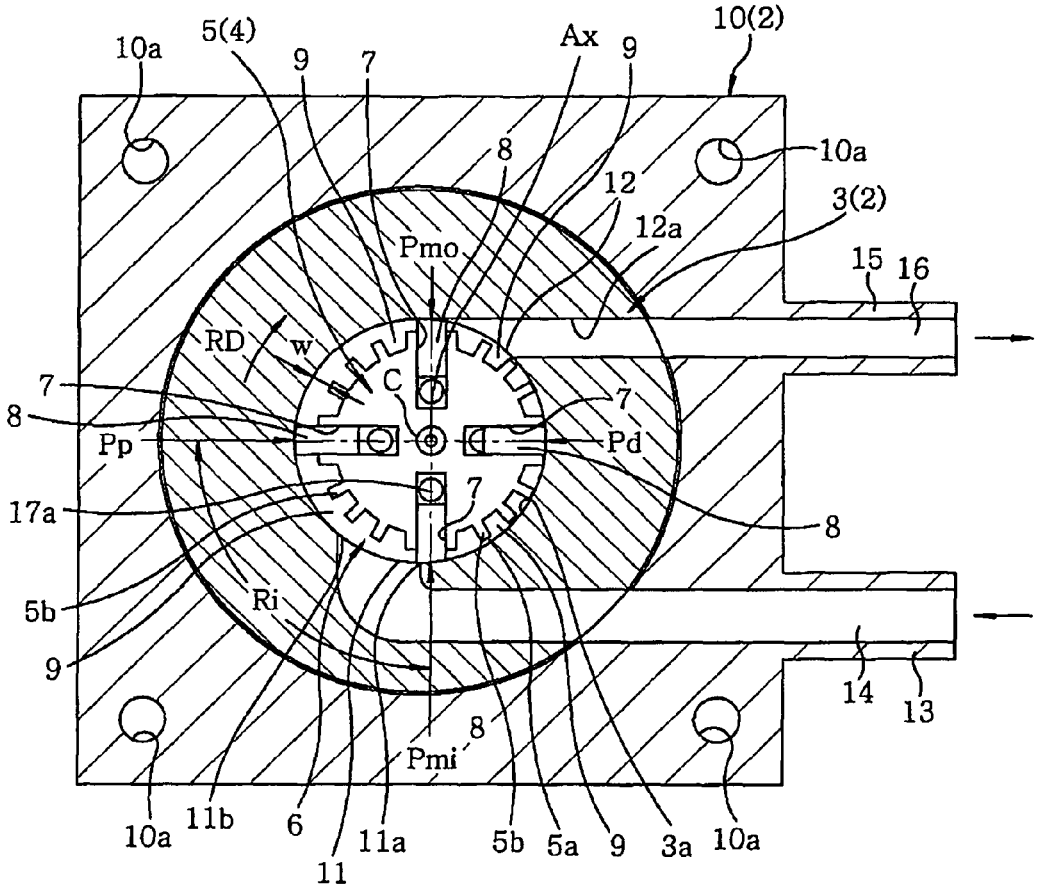
FIG. 1 is a section view of a vane pump in accordance with a first embodiment of the present invention, which is taken along a plane perpendicular to a rotational axis.

Hereinafter, preferred embodiments of the present invention will be described in detail with reference to the accompanying drawings. The common components included in the embodiments and the modified examples described below are designated by the same reference characters and redundant descriptions thereof will be omitted.

First Embodiment

Figure 2:
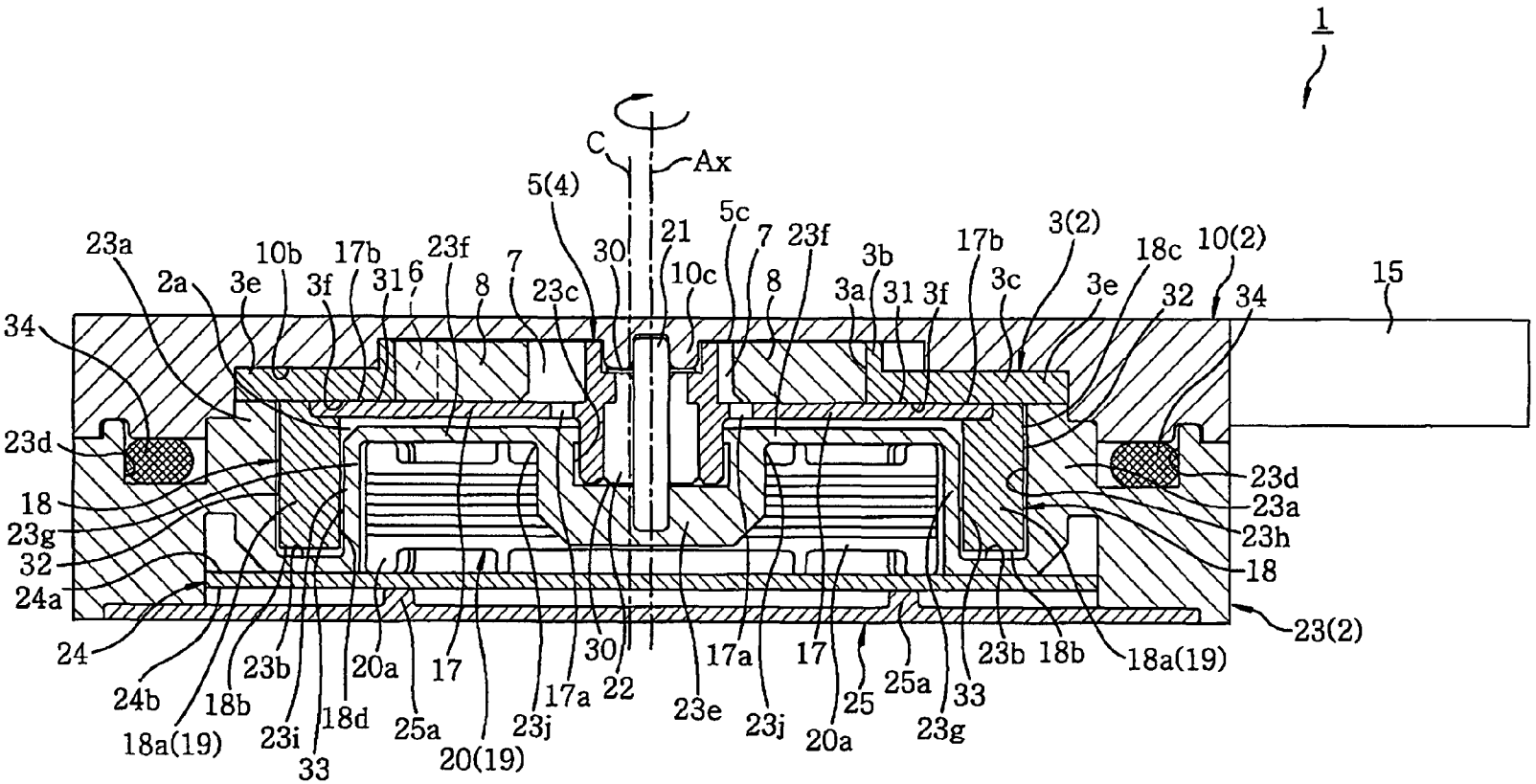
FIG. 2 is a section view of the vane pump in accordance with the first embodiment of the present invention, which is taken along a plane containing the rotational axis.
Figure 3:
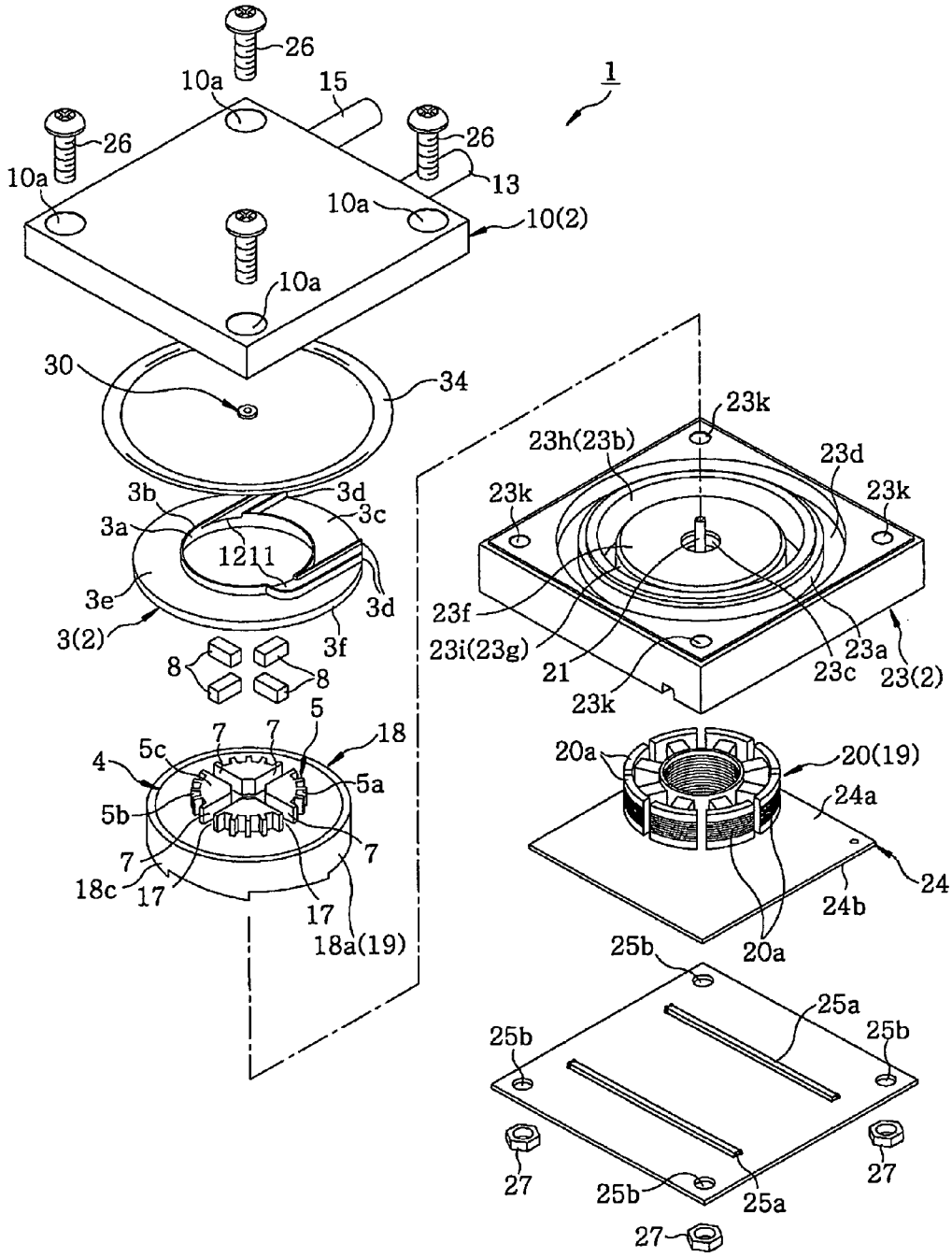
FIG. 3 is an exploded perspective view showing the vane pump in accordance with the first embodiment of the present invention.
Figure 4:
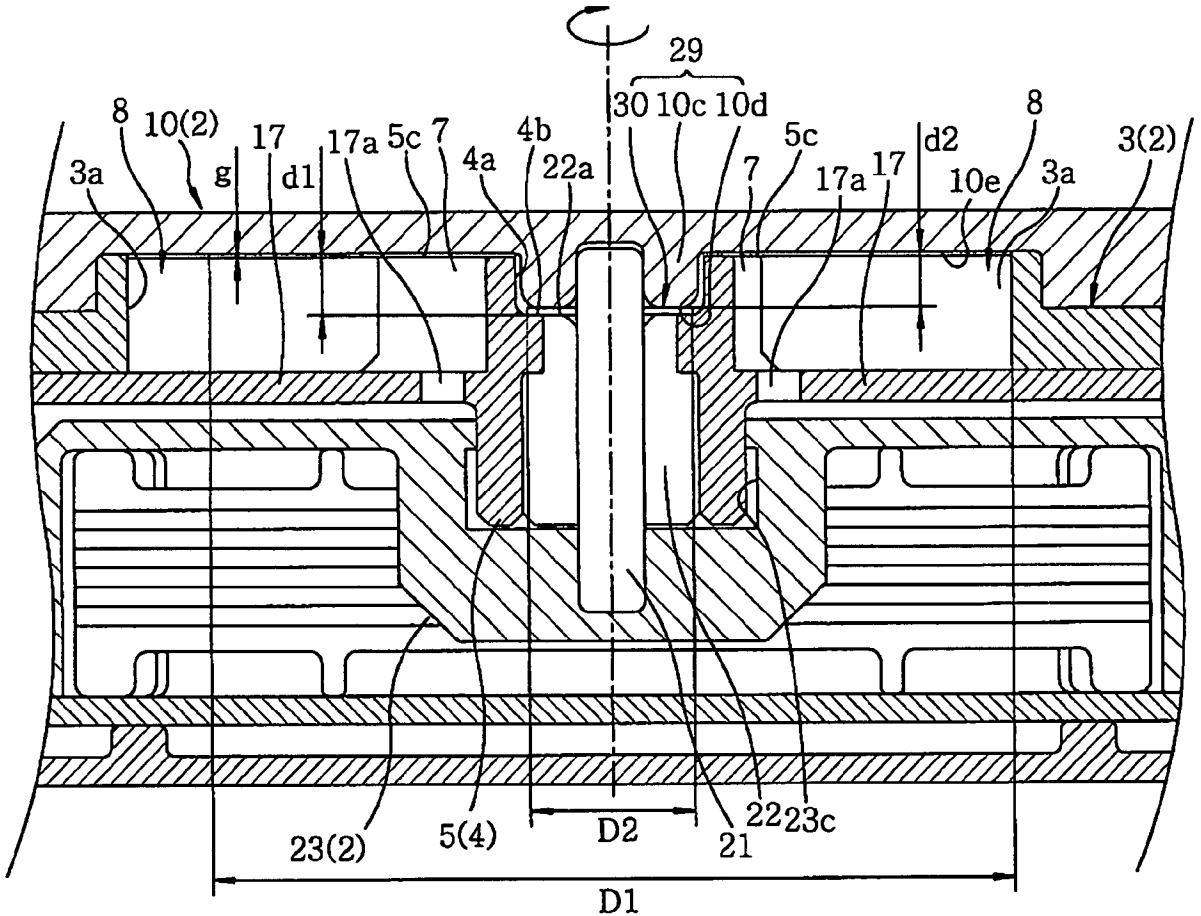
FIG. 4 is a partially enlarged view of the vane pump shown in FIG. 2.

FIG. 1 is a section view of a vane pump in accordance with a first embodiment of the present invention, which is taken along a plane perpendicular to a rotational axis. FIG. 2 is a section view of the vane pump in accordance with the first embodiment of the present invention, which is taken along a plane containing the rotational axis. FIG. 3 is an exploded perspective view showing the vane pump in accordance with the first embodiment of the present invention. FIG. 4 is a partially enlarged view of the vane pump shown in FIG. 2. In the following description, the upper side in FIGS. 2, 3 and 4 will be referred to as an axial upper side of a rotational axis Ax and the lower side as an axial lower side for the sake of convenience.

Referring first to FIG. 1, description will be made on the configuration of a vane pump 1 for drawing and discharging a working fluid.

As shown in FIG. 1, the vane pump 1 in accordance with the present embodiment includes a casing 2, an annular ring 3 arranged within the casing 2 and provided with a substantially cylindrical inner circumferential surface 3*a*, and a rotary unit 4 rotating about a rotational axis Ax, the rotary unit 4 having a substantially cylindrical columnar base portion 5 with an outer circumferential surface 5*a*. An annular chamber 6 for containing a working fluid (liquid) is formed between the inner circumferential surface 3*a* of the annular ring 3 and the outer circumferential surface 5*a* of the base portion 5 of the rotary unit 4. The width w of the annular chamber 6 varies along the circumferential direction of the rotational axis Ax. In the present embodiment, the center C of the inner circumferential surface 3*a* is offset from the rotational axis Ax in parallel so that the base portion 5 of the rotary unit 4 is off-centered with respect to the inner circumferential surface 3*a* of the annular ring 3. Therefore, the width w of the annular chamber 6 is minimized in the right end position in FIG. 1. The width w is gradually increased clockwise from the right end position and is maximized in the left end position. Then the width w is gradually reduced clockwise from the left end position toward the right end position and is minimized in the right end position.

The base portion 5 has a plurality of (four, in the present embodiment) slits 7 radially extending with respect to the rotational axis Ax of the rotary unit 4 and opened radially outwards. A vane 8 of substantially square bar shape or substantially band plate shape is slidably fitted in each of the slits 7. The vane 8 is forced radially outwards in each of the slits 7 by the centrifugal force generated upon rotation of the rotary unit 4 and by the pressure of the working fluid introduced into the portion each of the slits 7 near the rotational axis Ax. This ensures that the vane 8 rotates together with the rotary unit 4 while making sliding contact with the inner circumferential surface 3*a*.

The annular chamber 6 is divided into a plurality of (four, in the present embodiment) pump chambers 9 by the vanes 8 circumferentially arranged at a regular pitch, the number of the pump chambers 9 being the same as the number of the vanes 8. As the rotary unit 4 and the vanes 8 make rotation, the volumes of the pump chambers 9 vary with the change in the width w of the annular chamber 6. In other words, the volume of each of the pump chambers 9 is minimized in the right end position in FIG. 1. As the rotary unit 4 rotates in the rotational direction RD (clockwise in FIG. 1), the volume of each of the pump chambers 9 is gradually increased and maximized in the left end position. If the rotary unit 4 further rotates clockwise from that position, the volume of each of the pump chambers 9 is gradually reduced and minimized in the right end position. In the present embodiment, the volume of each of the pump chambers 9 is expanded in the lower half section in FIG. 1 and contracted in the upper half section during one clockwise revolution of the rotary unit 4. Taking this into account, on the inner circumferential surface 3*a* of the ring 3 and in the casing 2 (i.e., the below-mentioned first casing body 10), an inlet port 11 is formed so as to face the volume expanding section and an outlet port 12 is formed so as to face the volume contracting section. The inlet port 11 communicates with an intake path 14 of an intake pipe 13 protruding from one side surface of the below-mentioned first casing body 10. The outlet port 12 remains in communication with a discharge path 16 defined within a discharge pipe 15 protruding parallel to the intake pipe 13.

If the rotary unit 4 rotates in the rotational direction RD in FIG. 1, the pump chamber 9 defined by two adjoining vanes 8 moves from the right end position to the left end position while expanding the volume thereof. Thus the working fluid is drawn from the intake path 14 into the pump chamber 9 through the inlet port 11. Subsequently, the pump chamber 9 moves from the left end position to the right end position while contracting the volume thereof. Thus the working fluid is discharged from the pump chamber 9 toward the discharge path 16 through the outlet port 12. The drawing and discharging operations of the working fluid is performed one after another with respect to the plurality of pump chambers 9, whereby the working fluid is continuously drawn and discharged by the vane pump 1.

The configuration of each component part of the vane pump 1 of the present embodiment will be described in detail with reference to FIGS. 1 through 5.

As shown in FIG. 2, the slits 7 formed in the base portion 5 of the rotary unit 4 are closed by a bottom wall portion 17 at the axial lower sides thereof. The vanes 8 are allowed to reciprocate within the slits 7 while making sliding contact with the bottom wall portion 17. In other words, the bottom wall portion 17 of the present embodiment is equivalent to a guide wall portion that radially guides the vanes 8 at the axial lower sides of the slits 7. The bottom wall portion 17 has communication holes 17*a* communicating with the radial inner portions of the slits 7. The pressure of the working fluid is introduced into the slits 7 from the rear surface side (the axial lower side) of the bottom wall portion 17 through the communication holes 17*a*.

The bottom wall portion 17 is formed into a disk shape in a concentric but perpendicular relationship with the rotational axis Ax. The bottom wall portion 17 extends radially outwards beyond the outer circumferential surface 5*a* of the base portion 5 in a flange-like shape. A substantially cylindrical skirt portion 18 protrudes from the outer peripheral edge of the bottom wall portion 17. The skirt portion 18 is concentric with the rotational axis Ax and protrudes away from the base portion 5 (i.e., toward the axial lower side) with a substantially uniform thickness.

The skirt portion 18 functions as a rotor of an electric motor 19 for driving the rotary unit 4 and includes a magnetization portion 18*a* alternately magnetized with N and S poles along the circumferential direction thereof in a corresponding relationship with the teeth 20*a* of a stator core 20 wound with coils. At least the portion of the skirt portion 18, which serves as the magnetization portion 18*a*, is made of a magnetic material. In this regard, only the portion of the skirt portion 18 facing the teeth 20*a* may be made of a magnetic material (e.g., a hard magnetic material such as a ferrite magnet or a samarium cobalt magnet) Alternatively, the entirety of the skirt portion 18 or the entirety of the rotary unit 4 may be made of a magnetic material. In this case, the rotary unit 4 or the skirt portion 18 can be molded by mixing a resin material with powdery or granular magnetic filler formed of a magnetic material.

As shown in FIGS. 1 and 3, the outer circumferential surface 5*a* of the base portion 5 is regularly indented radially inwards at a specified pitch to thereby form blade portions 5*b*. These blade portions 5*b* rotate together with the base portion 5 (the rotary unit 4). The ability of the vane pump 1 to draw the working fluid into each of the pump chambers 9 is enhanced when the blade portions 5*b* oppose the inlet port 11, and the ability of the vane pump 1 to discharge the working fluid from the pump chambers 9 is improved when the blade portions 5*b* oppose the outlet port 12.

As shown in FIG. 2, a bearing 22 for rotatably supporting a shaft 21 is fixed in the central portion of the base portion 5 (the rotary unit 4). The bearing 22 may be a slide bearing such as a metal bush or the like or may be a rolling bearing such as a needle bearing or the like.

The rotary unit 4 is configured to rotate about the rotational axis Ax within an internal space 2*a* (see FIG. 2) defined by the casing 2. In the present embodiment, the casing 2 includes a first casing body 10 arranged at the axial upper side (or at the upper side in FIGS. 2 and 3) and a second casing body 23 positioned at the axial lower side (or at the lower side in FIGS. 2 and 3). The ring 3 for defining the outer circumference of the annular chamber 6 (the inner circumferential surface 3*a*) is arranged within the casing 2.

Referring to FIG. 3, the ring 3 includes a tubular portion 3*b* defining the outer circumference of the annular chamber 6, an annular flange portion 3*c* extending radially outwards from the axial lower side of the tubular portion 3*b*, and ribs 3*d* forming a portion of the side walls of the intake path 14 and the discharge path 16. The tubular portion 3*b* and the ribs 3*d* are upstanding from the flange portion 3*c* substantially at the same height in the axial direction of the rotational axis Ax.

As shown in FIG. 2, the ring 3 is accommodated within a recess portion 10*b* formed in the first casing body 10. The recess portion 10*b* is recessed in such a shape that the tubular portion 3*b* and the ribs 3*d* of the ring 3 can be fitted thereto. The flange portion 3*c* of the ring 3 has an outer peripheral portion 3*e* that makes contact with an annular wall portion 23*a* of the second casing body 23 at the opposite side from the recess portion 10*b*. The outer peripheral portion 3*e* is gripped by the first and second casing bodies 10 and 23 so that that the ring 3 can be fixed in the direction of the rotational axis Ax.

The second casing body 23 includes a substantially annular recess portion 23*b* for accommodating the skirt portion 18 of the rotary unit 4 and a recess portion 23*c* for accommodating the portion of the bearing 22 of the rotary unit 4 that protrudes toward the second casing body 23 (i.e., toward the axial lower side or the lower side in FIGS. 2 and 3).

The portion of the second casing body 23, which exists radially outwards of the annular wall portion 23*a* located radially outwards of the recess portion 23*b*, serves as a contact surface that makes contact with the first casing body 10. An annular groove portion 23*d* for holding an O-ring 34 is formed on the contact surface. The O-ring 34 fitted into the groove portion 23*d* provides a seal in the boundary portion between the first and second casing bodies 10 and 23. Seal members (e.g., gaskets or O-rings) may be suitably arranged in other boundary portions between the members (e.g., in the boundary surface between the flange portion 3*c* of the ring 3 and the first casing body 10), thereby improving the sealability in the respective boundary portions.

The shaft 21 is installed to extend between the bottom wall portion 23*e* of the recess portion 23*c* and the protrusion portion 10*c* of the first casing body 10, the center of the shaft 21 being aligned with the rotational axis Ax. The shaft 21 extends through the bearing 22 provided at the center of the rotary unit 4 and is rotatably supported by the bearing 22.

As shown in FIG. 2, an annular protrusion portion 23*f* protruding from the opposite side of the rotary unit 4 (i.e., the axial lower side or the lower side in FIG. 2) toward the rotary unit 4 is formed between the recess portion 23*b* and the recess portion 23*c*. A stator core 20 forming a part of the motor 19 is accommodated within an annular recess portion 23*j* defined on the rear surface of the protrusion portion 23*f*.

Referring to FIGS. 2 and 3, the stator core 20 is attached to the central area of a surface 24*a* of a substrate 24. The stator core 20 includes a cylinder portion 20*b* centrally positioned in a concentric relationship with the rotational axis Ax and a plurality of teeth 20*a* extending radially outwards from the cylinder portion 20*b*. Coils are wound on the teeth 20*a*.

Various kinds of electronic parts (not shown) are mounted on the rear surface 24*b* of the substrate 24, i.e., on the opposite side (the axial lower side or the lower side in FIG. 2) of the substrate 24 from the surface 24*a* provided with the stator core 20. A circuit for driving the motor 19 and other circuits are also formed on the rear surface 24*b* of the substrate 24. In the present embodiment, the current supply state of the coils wound on the respective teeth 20*a* are suitably changed by a driving circuit formed in the substrate 24 to switch the polarities of the outer peripheral portions of the teeth 20*a*. Thus a circumferential thrust force is applied to the magnetization portion 18*a* (the skirt portion 18) radially opposing the teeth 20*a*, thereby rotating the rotary unit 4. This means that at least the partition wall portion 23*g* of the second casing body 23 interposed between the outer peripheral portions of the stator core 20 (the teeth 20*a*) and the skirt portion 18 needs to be made magnetically permeable. For that reason, the partition wall portion 23*g* or the entirety of the second casing body 23 is made of a magnetically permeable material (e.g., stainless steel or resin).

The substrate 24 is attached so as to close the recess portion 23*j* from the opposite side (the axial lower side) of the rotary unit 4. Furthermore, the substrate 24 is covered by a substrate cover 25 from the opposite side (the axial lower side) of the rotary unit 4. The substrate cover 25 is provided with lugs 25*a* that create a gap for arrangement of electronic parts between the substrate 24 and the substrate cover 25.

The first and second casing bodies 10 and 23 have a substantially square shape when seen in the direction of the rotational axis Ax. In the four corners of the casing bodies 10 and 23, there are respectively formed through-holes 10*a* and 23*k* into which screws 26 are fitted to combine the casing bodies 10 and 23 together. The vane pump 1 is fabricated by inserting the screws 26 into the through-holes 10*a* and 23*k* and the through-holes 25*b* formed in the four corners of the substrate cover 25 and then threadedly coupling nuts 27 to the screws 26.

The material and production method of the respective component parts of the vane pump 1 is suitably selected by taking into account the wear resistance, corrosion resistance, swelling resistance, moldability and part accuracy as well as the magnetizability and magnetic permeability mentioned above.

In the present embodiment, the rotary unit 4 includes a hydraulic force generating portion 28 that generates, upon rotation of the rotary unit 4, a hydraulic force acting toward the axial upper side of the rotational axis Ax (i.e., toward the upper side in FIGS. 2 and 3). The hydraulic force thus generated presses the rotary unit 4 against the first casing body 10 which is positioned at the opposite side from the bottom wall portion 17. The hydraulic force generating portion 28 includes slanting surfaces formed on the end surface 18*b* of the axial lower side of the skirt portion 18 and inclined with respect to the rotational direction RD of the rotary unit 4. The slanting surfaces are formed to obliquely extend from the axial lower side toward the axial upper side (i.e., from the lower side toward the upper side in FIG. 3) in between the leading end and the trailing end thereof along the rotational direction RD. Therefore, the working fluid impinging against the slanting surfaces during rotation of the rotary unit 4 applies a hydraulic force to the rotary unit 4, thereby pushing the rotary unit 4 toward the axial upper side (i.e., the upper side in FIG. 3).

Referring to FIG. 4, the first casing body 10 is provided with a thrust support portion 29 for slidably supporting the rotary unit 4 that rotates under the hydraulic force (or the thrust force) acting toward the axial upper side. More specifically, the portion of the first casing body 10 supporting the shaft 21 inserted therein protrudes toward the axial lower side to form a protrusion portion 10*c* with a tip end surface 10*d*. A recess portion 4*a* with a bottom surface 4*b* is formed in the central portion of the rotary unit 4 (the base portion 5). The bottom surface 4*b* of the recess portion 4*a* makes contact with the tip end surface 10*d* of the protrusion portion 10*c* through a washer 30. In the present embodiment, the washer 30 is interposed between the thrust support portion 29 and the base portion 5 of the rotary unit 4, and the axial end surface 22*a* of the bearing 22 arranged in the central portion of the rotary unit 4 (and partially exposed in the bottom surface 4*b* of the recess portion 4*a*) is allowed to make contact with the washer 30. This makes it easy to increase the wear resistance of the thrust support portion 29 and the base portion 5 of the rotary unit 4. With this configuration, the wear resistance of the thrust support portion 29 and the base portion 5 of the rotary unit 4 can be adjusted by changing the specifications (such as the material, size and hardening treatment) of the washer 30 and the sliding contact portion of the bearing 22. The specifications of the main body portion (including the base portion 5 and the bottom wall portion 17) of the rotary unit 4 can be set from the standpoint of weight reduction, slidability of other sliding portions, corrosion resistance and so forth.

As shown in FIG. 4, the diameter D2 of the sliding portion of the thrust support portion 29 is set smaller than the diameter D1 of the base portion 5. If no particular thrust support portion is employed despite the provision of the hydraulic force generating portion 28, the end surface 5*c* of the base portion 5 will make sliding contact with the first casing body 10, which may possibly lead to increased sliding resistance. Since the diameter D2 of the sliding portion of the thrust support portion 29 is set smaller than the diameter D1 of the base portion 5 in the present embodiment, it is possible to further reduce the sliding resistance and the friction of the rotary unit 4.

Referring again to FIG. 2, the gap 31 between one axial end surface 17*b* of the bottom wall portion 17 and the other axial end surface 3*f* of the ring 3 is set narrow in order to reduce, as far as possible, the quantity of the working fluid leaked through the gap between the end surfaces 17*b* and 3*f*. A washer is also arranged in the axial lower side of the bearing 22.

In the present embodiment, the gap between the outer circumferential surface 5*a* of the base portion 5 and the inner circumferential surface 3*a* of the ring 3 (or the outer circumferential surface of the annular chamber 6), i.e., the width w of the annular chamber 6, is smallest in the right end position Pd and greatest in the left end position Pp in FIG. 1. Thus, the section extending from the right end position Pd to the left end position Pp along the rotational direction RD (the clockwise direction in FIG. 1) becomes an expanding section. The section extending from the left end position Pp to the right end position Pd along the rotational direction RD becomes a contracting section. In this connection, the right end position Pd is the starting position of the expanding section and the terminating position of the contracting section, while the left end position Pp is the terminating position of the expanding section and the starting position of the contracting section. In FIG. 1, the exactly middle position between the starting position Pd and the terminating position Pp of the expanding section is denoted by a middle position Pmi, while the exactly middle position between the starting position Pp and the terminating position Pd of the contracting section is referred to as a middle position Pmo.

In the present embodiment, as shown in FIG. 1, the inlet port 11 through which to draw the working fluid is arranged to face the portion of the annular chamber 6 extending between the middle position Pmi and the terminating position Pp of the expanding section in which the pump chamber 9 expands. More specifically, the trailing side edge 11*a* and the leading side edge 11*b* of the inlet port 11 along the rotational direction RD are all arranged within the angular range of 90 degrees extending from the middle position Pmi to the terminating position Pp. Needless to say, the trailing side edge 11*a* may be arranged in the middle position Pmi, the leading side edge 11*b* being in the terminating position Pp.

In the present embodiment, therefore, the fluid moving from the intake path 14 toward the annular chamber 6 flows from the side (the lower side in FIG. 1) distant from an imaginary line segment interconnecting the starting position Pd and the terminating position Pp of the expanding section of the pump chamber 9 (a single-dotted chain line laterally extending through the rotational axis Ax in FIG. 1) toward the imaginary line segment (toward the upper side in FIG. 1). Near the inlet port 11, the fluid in the pump chamber 9 also flows toward the imaginary line segment. Therefore, the fluid introduced from the intake path 14 into the annular chamber 6 and the fluid moving together with the movement of the pump chamber 9 (the vanes 8) are prevented from colliding with each other in the vicinity of the inlet port 11. This makes it possible to suppress the reduction in pump efficiency attributable to the turbulence or vortex of the fluid which would otherwise be generated near the inlet port 11.

In the present embodiment, the discharge path 16 includes a wall surface 12*a* positioned on the radially outer side with respect to the rotational axis Ax and joined to the outlet port 12 so as to extend along the tangential line of the outer circumferential surface of the annular chamber 6, i.e., the inner circumferential surface 3*a* of the ring 3.

Therefore, the inner circumferential surface 3*a* of the ring 3 can be smoothly joined to the wall surface 12*a* of the discharge path 16. This makes it possible to suppress the reduction in pump efficiency attributable to the separation or turbulence of the fluid which would otherwise be generated near the outlet port 12.

In the present embodiment, the rotary unit 4 is pushed toward the axial upper side of the rotational axis Ax by the hydraulic force generating portion 28. With this configuration, it is possible to suppress the rotary unit 4 from making axial reciprocating movement during its rotation by pressing the rotary unit 4 against the axial upper side of the casing 2 (against the first casing body 10). This makes it possible to suppress generation of vibration or noises caused by the axial reciprocating movement. As shown in FIG. 4, the gap g between the axial upper side end surface 5*c* of the base portion 5 and the axial lower side end surface 10*e* of the first casing body 10 can be defined with increased precision and accuracy by suitably setting the size d1 of the rotary unit 4 and the size d2 of the first casing body 10. This makes it possible to avoid the increase in leaked fluid quantity and the reduction in pump efficiency, which would be caused by the increase and change of the gap size. In addition, it is possible to reduce the variation (the pump-by-pump variation) in the discharge amount of the vane pump 1.

Provision of the bottom wall portion 17 for slidably supporting the vanes 8 at the axial lower side thereof makes it possible to suppress the vanes 8 from moving toward the axial lower side. This helps prevent the generation of vibration or noises which would be caused by the axial reciprocating movement of the vanes 8, while suppressing the reduction in pump efficiency which would be caused by the increase in leaked fluid quantity. With this configuration, the rotary unit 4 and the vanes 8 are caused to move toward the axial upper side.

Second Embodiment

Figure 5:
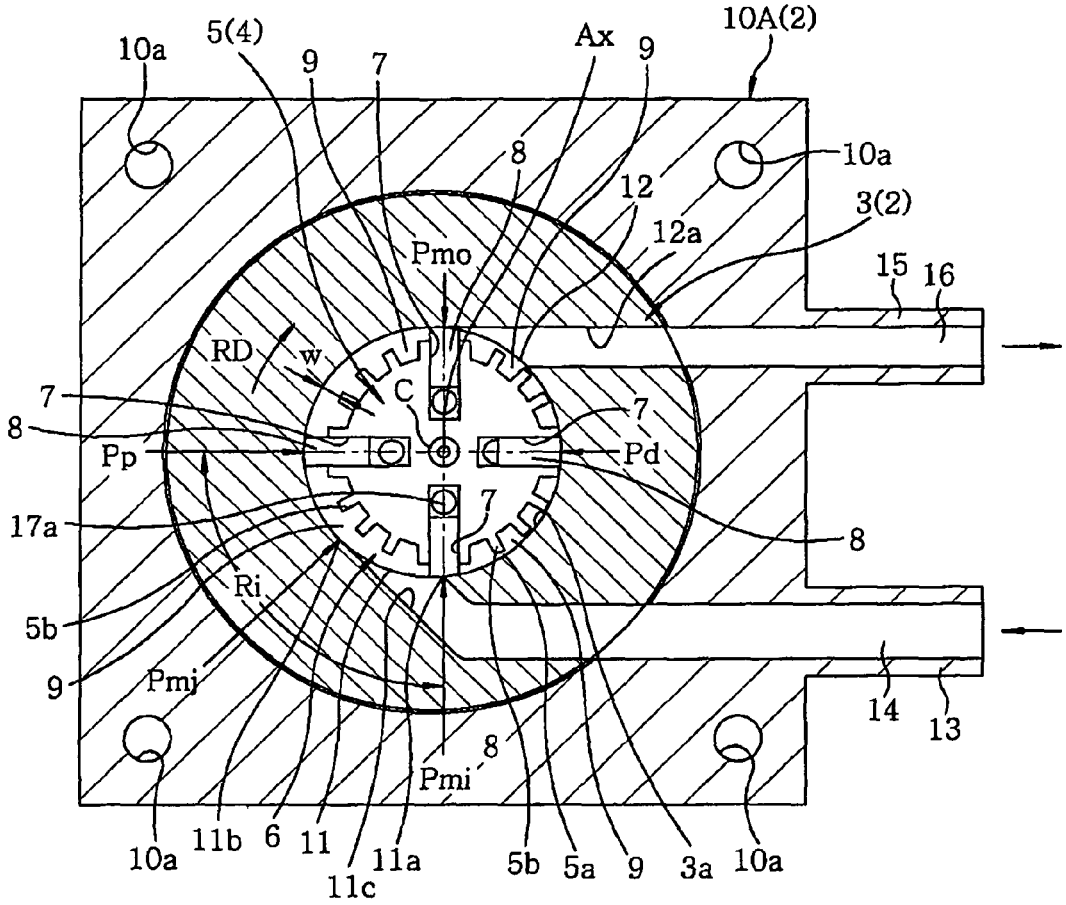
FIG. 5 is a section view of a vane pump in accordance with a second embodiment of the present invention, which is taken along the plane perpendicular to the rotational axis.

FIG. 5 is a section view of a vane pump in accordance with a second embodiment of the present invention, which is taken along the plane perpendicular to the rotational axis of the vane pump.

The vane pump of the present embodiment has essentially the same configuration as the vane pump 1 described in respect of the first embodiment.

At the intake side, the inlet port 11 through which to draw the working fluid is arranged to face the portion of the annular chamber 6 extending between the middle position Pmi and the terminating position Pp of the expanding section in which the pump chamber 9 expands.

At the discharge side, the discharge path 16 includes a wall surface 12*a* positioned on the radially outer side with respect to the rotational axis Ax and joined to the outlet port 12 so as to extend along the tangential line of the outer circumferential surface of the annular chamber 6, i.e., the inner circumferential surface 3*a* of the ring 3.

In the present embodiment, as shown in FIG. 5, the intake path 14 arranged on the upstream side of the inlet port 11 includes a wall surface 11*c* positioned on the radially outer side with respect to the rotational axis Ax and joined to the inlet port 11 so as to extend along the tangential line of the outer circumferential surface of the annular chamber 6, i.e., the inner circumferential surface 3*a* of the ring 3.

With the present embodiment, therefore, the wall surface 11*c* of the intake path 14 can be smoothly joined to the inner circumferential surface 3*a* of the ring 3. This makes it possible to suppress the reduction in pump efficiency attributable to the separation or turbulence of the fluid which would otherwise be generated near the inlet port 11.

While the embodiments and modified examples of the present invention have been described hereinabove, the present invention is not limited to the embodiments and modified examples described above but may be changed or modified in many different forms. For example, the detailed configuration of the rotary unit, the ring and the casing of the vane pump is not limited to the above-described embodiments. The position and shape of the inlet port, the outlet port, the intake path and the discharge path may be arbitrarily changed or combined within the scope of the present invention.

What is claimed is:

1. A vane pump comprising:

a casing;

an annular ring arranged within the casing and provided with a cylindrical inner circumferential surface; and a rotary unit rotatably held within the casing, the rotary unit including a cylindrical columnar base portion with a plurality of radially outwardly opened slits extending radially with respect to a rotational axis of the rotary unit and vanes slidably fitted in the respective slits, an annular chamber being formed around the base portion within the casing and divided into a plurality of pump chambers by the vanes, each of the pump chambers having a volume cyclically expanded and contracted during rotation of the rotary unit to discharge the fluid drawn into each of the pump chambers, wherein the annular chamber is formed between the inner circumferential surface of the annular ring and an outer circumferential surface of the base portion, wherein a leading end of each of the vanes makes sliding contact with the inner circumferential surface of the annular ring during the rotation of the rotary unit, and wherein the casing includes an inlet port through which to draw the fluid into the annular chamber, the inlet port having a width in a direction of the rotational axis smaller than that of each of the vanes and being arranged so as to face only a portion of the annular chamber extending between a middle position and a terminating position of an expanding section in which each of the pump chambers expands.

2. The vane pump of claim 1, wherein the casing includes an intake path arranged on an upstream side of the inlet port, the intake path including a wall surface positioned on a radially outer side with respect to the rotational axis and joined to the inlet port so as to extend along a tangential line of an outer circumferential surface of the annular chamber.

3. The vane pump of claim 2, wherein the casing includes an outlet port through which to discharge the fluid from the annular chamber and a discharge path arranged on a downstream side of the outlet port, the discharge path including a wall surface positioned on a radially outer side with respect to the rotational axis and joined to the outlet port so as to extend along a tangential line of an outer circumferential surface of the annular chamber.

4. The vane pump of claim 1, wherein the casing includes an outlet port through which to discharge the fluid from the annular chamber and a discharge path arranged on a downstream side of the outlet port, the discharge path including a wall surface positioned on a radially outer side with respect to the rotational axis and joined to the outlet port so as to extend along a tangential line of an outer circumferential surface of the annular chamber.

* * * * *